United States Patent [19]

Umstattd

[11] 4,299,243

[45] Nov. 10, 1981

[54] FINGERNAIL REINFORCING METHOD

[76] Inventor: Karen Umstattd, 2612 Boll St., Dallas, Tex. 75204

[21] Appl. No.: 209,512

[22] Filed: Nov. 24, 1980

[51] Int. Cl.[3] ..... A45D 29/00

[52] U.S. Cl. ..... 132/73

[58] Field of Search ..... 132/73

[56] References Cited

U.S. PATENT DOCUMENTS

| | | | |
|---|---|---|---|
| 1,978,144 | 10/1934 | Roberts | 132/73 |
| 2,209,408 | 7/1940 | Litt | 132/73 |
| 2,581,982 | 1/1952 | Terry | 132/73 |

*Primary Examiner*—Robert Peshock

*Attorney, Agent, or Firm*—Dennis T. Griggs

[57] ABSTRACT

A method for reinforcing fingernails uses a thin sheet of porous reinforcing material covering outward portions of the nail. The method comprises a plurality of steps wherein the reinforcing material is impregnated with a quick-drying liquid adhesive, alternating with a plurality of shaping and smoothing steps. The reinforced portion of the fingernail forms a smooth, continuous surface with the non-reinforced portion of the fingernail.

4 Claims, 11 Drawing Figures

FINGERNAIL REINFORCING METHOD

BACKGROUND OF THE INVENTION

1. Field of the Invention

The present invention relates generally to the maintenance of fingernails, and more specifically to a method for reinforcing the outer portion of nails to prevent cracking, chipping and breaking.

2. Description of the Prior Art

Long, carefully manicured fingernails are fashionable and enhance the overall feminine appearance. Long fingernails project beyond the tip of the finger or nail bed, often up to a distance of one-half inch or more, and are especially prone to cracking, chipping, breaking or splitting.

Many methods have been developed in an attempt to protect the extended end of the fingernail. These methods fall generally into two classes. The first class consists of permanently or semi-permanently attaching a pre-formed artificial fingernail to the upper surface of the natural nail. The artificial nail is polished in a conventional manner from a material that is less susceptible to wear and abrasion than a natural nail.

This method has several limitations. First, as the natural nail grows, a ridge forms at the back edge of the artificial nail. This ridge is not present when the back edge of the artificial nail abuts against the cuticle, but is exposed as the nail grows out. The ridge detracts from the smooth appearance of the nail, and can get caught on sharp objects, resulting in the artificial nail splintering or peeling away from the natural nail. A second limitation relates to the difficulty in matching the size of the pre-formed nail with the natural nail. The artificial nail must completely cover the natural nail to avoid the presence of unsightly ridges. However, if the artificial nail extends beyond the sides of the natural nail, extreme discomfort can result. Differences in natural nail curvature complicate the application of the artificial nails.

The second general method consists of applying a coat of material to the surface of the nail which hardens thereon and forms an artificial fingernail. The artificial nail thus formed is very similar, when dry, to the pre-formed artificial nail. However, it is sometimes difficult to apply the paint-on nail to fingernails of different shapes and sizes. The paint-on artificial nail is usually applied through a mask having a pre-formed cut-out, and problems can occur when the cut-out is not the same size or shape as the natural nail. The mask goes around the nail bed and build-up material is applied to the nail bed. The form protects the surrounding skin from irritation by exposure to the build-up material and acts as a support to form free edge for an extended nail.

SUMMARY OF THE INVENTION

It is, therefore, an important object of the present invention to provide a method for reinforcing fingernails so that no special treatment is necessary as the natural nail grows. According to one aspect of the present invention, a thin layer of porous reinforcing material is used to cover the outer portion of the natural nail. In a plurality of steps as set forth in the detailed description, the porous material is impregnated with a liquid adhesive, and shaped to make a smooth surface with the uncovered natural nail. The reinforced natural nail then resembles and can be treated in the same manner as an unreinforced natural nail.

It is another object of the present invention that the method for reinforcing nails be easily accomplished. The present invention provides a simple step-by-step procedure for reinforcing the nail, and uses conventional materials easily found in the marketplace.

It is another object of the present invention to provide for reinforcement of artificial nails which are already in place, if desired. According to the present invention, the same procedure is followed whether the surface to be reinforced is the natural nail or a pre-existing artificial nail.

The novel features which characterize the invention are defined in the appended claims. The foregoing and other objects and advantages of the invention will herein appear, and for purposes of illustration, but not of limitation, a preferred embodiment of the present method is shown in the drawings.

DETAILED DESCRIPTION OF THE DRAWINGS

Referring to FIGS. 1 through 10, a finger 10 is used to demonstrate the method of the present invention for protecting a fingernail 12. The method of the present invention can also be used to protect toenails, if desired. For best results, the surface of the fingernail should be cleaned and smoothed before the steps of the method are undertaken.

Figure 1:
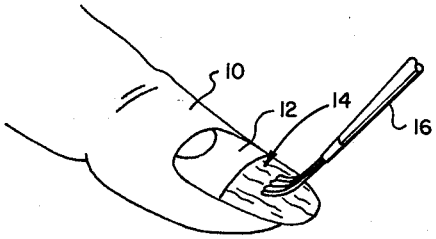
FIGS. 1 through 10 are perspective views illustrating the consecutive steps for reinforcing a fingernail according to the invention.
Figure 2:
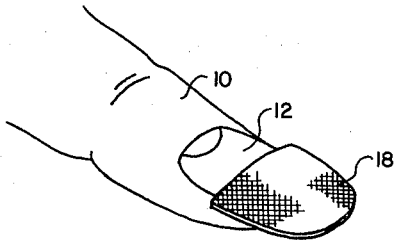

Referring to FIG. 1, a first coat of quick-drying adhesive 14 is applied to approximately the outer one-third to one-half of the fingernail 12. The adhesive 14 is a conventional brush-on nail adhesive, and may be applied by an adhesive brush 16. The adhesive 14 is not necessarily applied with a brush. A preferred product is 5 Second Nail Glue or similar and is applied with an applicator nozzle. The liquid adhesive preferably dries completely in 15 seconds or less. Referring to FIG. 2, a strip of reinforcing material 18 is firmly pressed against the first coat of adhesive 14. The reinforcing material 18 covers only that part of the fingernail 12 which is covered by the first coat of the adhesive 14, and preferably extends beyond the edges of the nail 12. The preferred method uses reinforcing material 18 made of 100% cotton unbleached muslin.

Figure 3:
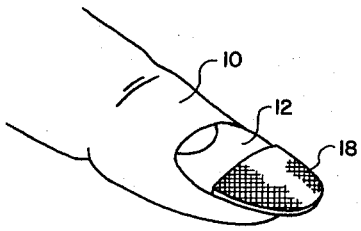
Figure 4:
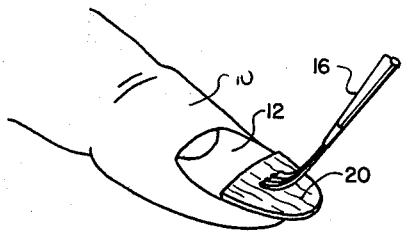

The reinforcing material 18 is then trimmed with scissors (not shown) or other means so that its edges are aligned with the edges of the fingernail 12, as shown in FIG. 3. Referring to FIG. 4, the next step of the preferred method is to apply a second coat of adhesive 20 to the surface of the reinforcing material 18 with a conventional adhesive brush 16. The second coat of adhesive 20 preferably contains enough adhesive material to completely saturate the reinforcing material 18.

Figure 5:
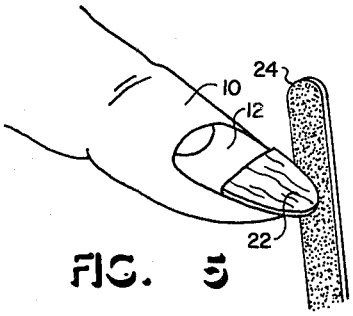
Figure 6:
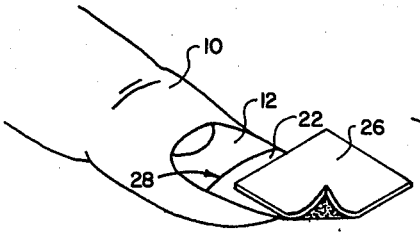

In reference to FIG. 5, after the second coat of adhesive 20 has dried, the edges of the adhesive-impregnated reinforcing material 22 and the fingernail 12 are smoothed by filing with energy paper 24 or an electric buffer. The surface of the impregnated reinforcing material 22 is then buffed as shown in FIG. 6. The buffing is preferably performed with No. 240 or other fine grit sandpaper 26. The buffing step is continued until the inner edge 28 of the impregnated reinforcing material 22 defines a substantially smooth transition between the reinforcing material 22 and the fingernail surface 12.

Figure 7:
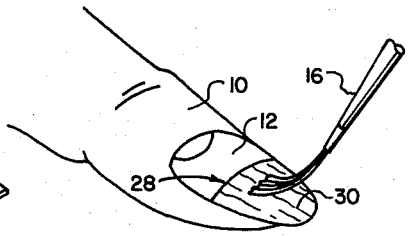
Figure 8:
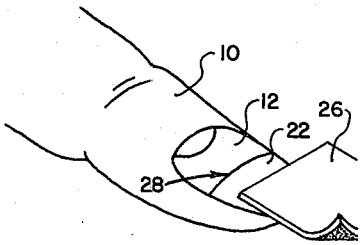

A third coat of adhesive 30 is applied by the adhesive brush 16 to the adhesive-impregnated reinforcing material 22 as shown in FIG. 7. In FIG. 8, after the third coat of adhesive 30 dries, the impregnated reinforcing material 22 is again buffed, preferably with No. 240 sandpaper 26.

Figure 9:
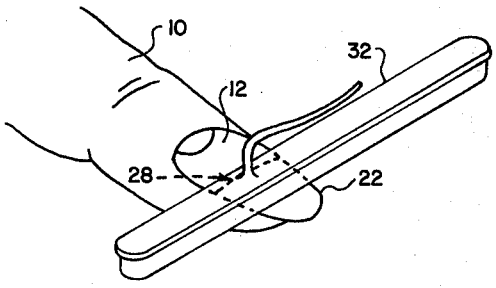

The impregnated reinforcing material 22 is then buffed with very fine emery paper 32, as shown in FIG. 9. After this step, the impregnated reinforcing material 22 and the surface of the fingernail 12 define a smooth surface, with no ridge detectable at the inner edge 28 of the impregnated reinforcing material 22. When the reinforcing material 18 is the preferred muslin, the impregnated reinforcing material 22 is almost transparent after this step. The weave of the muslin is visible upon close inspection.

Figure 10:
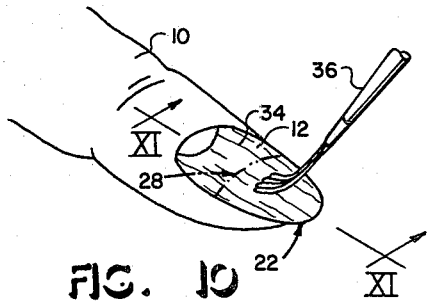

The fingernail 12 has now been reinforced, and is ready to be polished as desired. Referring to FIG. 10, a coat of conventional nail polish 34 is applied with a conventional polish brush 36. Additional coats of polish may be applied as desired.

Figure 11:
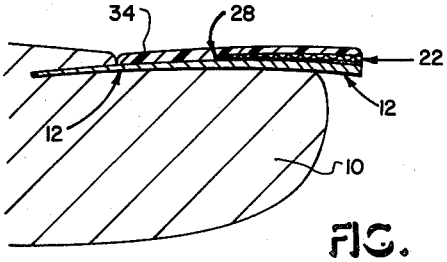
FIG. 11 is a cross-section of a fingernail which has been protected according to the method of the invention.

Referring to FIG. 11, a cross-section of a polished reinforced fingernail is shown. The impregnated reinforcing material 22 is firmly bonded to the surface of approximately the outer one-half of the fingernail 12. The inner edge 28 is shown out of proportion to indicate its location. There is a smooth transition between the fingernail 12 and the impregnated reinforcing material 22. One or more layers of polish 34 have been applied in a conventional manner. Moreover, the reinforced structure remains stable as the natural nail grows.

Although a preferred embodiment has been described in detail, it should be understood that various substitutions, alterations and modifications may become apparent to those skilled in the art. These modifications can be made without departing from the scope and spirit of the invention as defined in the appended claims.

What is claimed is:

1. A method for protecting a fingernail, comprising the steps of:

(a) applying a first coat of adhesive to a portion of the nail surface;

(b) applying a piece of reinforcing material over the first coat of adhesive;

(c) shaping the reinforcing material to conform to the shape of the nail;

(d) applying a second coat of adhesive to the reinforcing material so that the reinforcing material is saturated by the adhesive;

(e) shaping the impregnated reinforcing material to conform to the shape of the nail;

(f) buffing the surface of the reinforcing material until it is substantially flush with the nail surface;

(g) applying a third layer of adhesive to the surface of the reinforcing material; and, (h) buffing a second time until the surface of the reinforcing material is substantially flush with the surface of the nail.

2. The method of claim 1 further comprising:

(i) following step (h), applying one or more layers of polish to the surface of the reinforcing material and the exposed surface of the nail.

3. The method of claim 1, wherein the reinforcing material is composed of muslin cloth.

4. The method of claim 1, wherein the first coat of adhesive is applied to the outer one-third to one-half of the nail.

* * * * *